US005478716A

United States Patent [19]

Sekiya et al.

[11] Patent Number: 5,478,716

[45] Date of Patent: Dec. 26, 1995

[54] SILVER HALIDE PHOTOGRAPHIC EMULSION CONTAINING SILVER IODOBROMIDE GRAINS HAVING TWO OR MORE TWIN PLANES AND LIGHT-SENSITIVE SILVER HALIDE COLOR PHOTOGRAPHIC MATERIAL

[75] Inventors: Tadanobu Sekiya; Yasuo Honta; Syoji Matsuzaka, all of Hino, Japan

[73] Assignee: Konica Corporation, Japan

[21] Appl. No.: 308,396

[22] Filed: Sep. 19, 1994

Related U.S. Application Data

[63] Continuation of Ser. No. 168,967, Dec. 16, 1993, abandoned, which is a continuation of Ser. No. 990,727, Dec. 15, 1992, abandoned.

[30] Foreign Application Priority Data

Dec. 18, 1991 [JP] Japan ..... 3-353043

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,853,322 | 8/1989 | Makino et al. | 430/567 |
| 4,879,208 | 11/1989 | Urabe | 430/569 |
| 4,914,014 | 4/1990 | Daubendiek et al. | 430/567 |
| 5,068,173 | 11/1991 | Takehara et al. | 430/567 |

FOREIGN PATENT DOCUMENTS

| | | | |
|---|---|---|---|
| 443475 | 8/1991 | European Pat. Off. | G03C 1/035 |
| 18320 | 11/1991 | WIPO | G03C 1/035 |

*Primary Examiner*—Janet C. Baxter
*Attorney, Agent, or Firm*—Jordan B. Bierman; Bierman and Muserlian

[57] ABSTRACT

A silver halide emulsion is provided, which comprises silver halide twinned-crystal grains and satisfy the following requirements (1) and (2):

(1) the longest distance between twin planes is within the range of 10 to 100 Å on the average, (2) said silver halide grains each comprise a core comprising silver iodobromide having a silver iodide content of not less than 7 mol % and a shell comprising one or more layers different in halide composition from each other, in which at least one layer of the shell comprises silver iodobromide or silver bromide, the outermost layer having a silver iodide content of 0 to 4 mol %.

8 Claims, No Drawings

SILVER HALIDE PHOTOGRAPHIC EMULSION CONTAINING SILVER IODOBROMIDE GRAINS HAVING TWO OR MORE TWIN PLANES AND LIGHT-SENSITIVE SILVER HALIDE COLOR PHOTOGRAPHIC MATERIAL

This application is a continuation of application Ser. No. 08/168,967 filed Dec. 16, 1993, now abandoned, which is a continuation of application Ser. No. 07/990,727, filed Dec. 15, 1992, now abandoned.

FIELD OF THE INVENTION

The present invention relates to a silver halide photographic emulsion useful in the field of photography, and a light-sensitive silver halide color photographic material making use of the emulsion. More particularly it relates to a silver halide photographic emulsion remarkably improved in sharpness and also improved in pressure characteristics, and a light-sensitive silver halide color photographic material having superior sharpness, pressure characteristics and graininess, making use of the emulsion.

BACKGROUND OF THE INVENTION

In recent years, in the field of light-sensitive silver halide color photographic materials, there are much severer demands for high sensitivity and high image quality.

To answer such demands, a variety of researches have been focused on improvements in silver halide emulsions.

For example, U.S. Pat. No. 4,439,520, Japanese Patent Publications Open to Public Inspection [herein after referred to as Japanese Patent O.P.I. Publication(s)] No. 99751/1987 and No. 115435/1987 disclose a multi-layer light-sensitive silver halide color photographic material having a high sensitivity and a superior sharpness of dye images, in which a tabular grain silver halide emulsion with a grain thickness of 0.3 μm or less and an aspect ratio of 8 or more is used in a high-sensitivity layer.

Japanese Patent O.P.I. Publications No. 93344/1982, No. 145135/1979 and No. 151944/1982 also disclose techniques to improve sharpness by the use of a diffusible DIR compound.

Here, the approach from the tabular grain could be grouped as a technique to improve sharpness mainly by virtue of an optical effect, and the approach from the DIR compound as a technique to improve it by virtue of a development effect.

The light scattering due to silver halide grains has a great influence on the sharpness. As disclosed in the above publications, it is certainly effective in the sense of an improvement in sharpness that the grains are made to have a tabular form and have a thickness of 0.3 μm or less.

However, such tabular silver halide grains have an aspect ratio which is as high as 8 or more, and hence are very sensitive to stress, resulting in a great deterioration of pressure characteristics.

The term "pressure characteristics" has two meanings, one of which is what is called fogging by pressure, which is development of unexposed areas, caused by application of a pressure to light-sensitive silver halide photographic materials, and the other of which is what is called desensitization by pressure, which is a decrease in sensitivity at the time of exposure, or a decrease in density because of a pressure applied after the exposure.

As a matter of course, the pressure characteristics more deteriorate as tabular grains have a smaller thickness, because of their mechanical weakness. When, however, tabular grains have the same thickness, the pressure characteristics deteriorate as they have a higher aspect ratio. This can be explained to be due to the fact that a larger stress tends to be applied to tabular grains than to spherical grains even when materials have the same mechanical strength.

Even if grains having a relatively low aspect ratio are used in the case where all tabular grains contained in a light-sensitive layer are made to have a thickness of 0.3 μm or less in order to improve sharpness, the pressure characteristics can not still be improved when the halogen composition inside the grains is of uniform structure. As a means for improving the pressure characteristics, what is considered as one means is a method in which the halogen composition of silver halide grains is made to be of core/shell structure.

For example, Japanese Patent O.P.I. Publications No. 99433/1984, No. 35726/1985 and No. 147727/1985 disclose techniques by which the pressure characteristics have been improved using a core/shell emulsion comprising a silver halide grain having in its interior a core having a silver iodide content of 10 mol % or more. Follow-up of these techniques by the present inventors, however, has revealed that a great deterioration of graininess may result because of a broad grain size distribution and also because of a broad distribution of silver iodide content in individual grains.

As techniques to better prevent deterioration of graininess, for example, Japanese Patent O.P.I. Publications No. 151618/1988, No. 213637/1989 and No. 838/1990 disclose monodisperse tabular grains mainly having a hexagonal form.

These tabular silver halide grains that can prevent deterioration of graininess, however, have no aforesaid core/shell structure even though they comprise silver bromide or silver iodobromide, resulting in a deterioration of the pressure characteristics. Japanese Patent O.P.I. Publication No. 209445/1987 also discloses an emulsion of 5 or more in aspect ratio and 20% or less in relative standard deviation of average silver iodide content. Japanese Patent O.P.I. Publication No. 213845/1991 still also disclose a tabular grain emulsion having an aspect ratio of 3 or more and a grain thickness of about 0.3 μm and having been prepared through the step of forming grains by feeding fine silver iodide grains. Following-up of these techniques by the present inventors, however, has revealed that the pressure characteristics have been improved with insufficiency.

As discussed above, it has been difficult for the prior art to improve the pressure characteristics and the sharpness at the same time without causing the deterioration of graininess.

SUMMARY OF THE INVENTION

An object of the present invention is to provide a silver halide emulsion improved in pressure characteristics and sharpness at the same time without causing the deterioration of graininess, and a light-sensitive silver halide color photographic material making use of such an emulsion.

As a result of extensive studies, the present inventors have discovered that the above object can be achieved by the invention as described below.

1) A silver halide emulsion comprising a dispersion medium and light-sensitive silver halide grains, and satisfying the following requirements (a) and (b).

(a) A longest distance between twin planes of individual silver halide grains ranges from 10 Å to 100 Å on the average.

(b) Said silver halide grains comprise a core/shell type silver halide grain having a core comprising silver iodobromide and a singly- or multi-layered shell comprising a silver iodobromide or silver bromide, wherein said core contains not less than 7 mol % of silver iodide and an outermost layer of said shell contains not more than 4 mol % of silver iodide.

DETAILED DESCRIPTION OF THE INVENTION

The present invention will be described below in detail.

In preferred embodiments, the present invention is accomplished by being constituted as follows:

A silver halide emulsion comprising a dispersion medium and light-sensitive silver halide grains, and satisfying at least the following requirements (a) and (b), and preferably at least one of the following conditions (c) to (f).

(a) A longest distance between twin planes of individual silver halide grains ranges from 10 Å to 100 Å on the average;

(b) said silver halide grains comprise a core/shell type silver halide grain having a core comprising silver iodobromide and a singly- or multi-layered shell comprising a silver iodobromide or silver bromide, wherein said core contains not less than 7 mol % of silver iodide and an outermost layer of said shell contains not more than 4 mol % of silver iodide;

(c) at least 50% of the whole projected areas of said silver halide grains is held by hexagonal tabular grains having at least two twin planes;

(d) the hexagonal tabular grains as described in paragraph (c) have an average thickness of 0.3 μm or less;

(e) the hexagonal tabular grains as described in paragraph (c) have an average aspect ratio of 7 or less; and (f) relative standard deviation of average silver iodide content in each of said silver halide grains is 20% or less.

2) Part or the whole of said light-sensitive silver halide grains is formed by feeding at least one kind of emulsion comprised of fine-size silver halide grains formed in the presence of an aqueous protective colloid solution.

3) A light-sensitive silver halide color photographic material comprising a support and provided thereon a red-sensitive silver halide emulsion layer, a green-sensitive silver halide emulsion layer and a blue-sensitive silver halide emulsion layer, wherein at least one of said light-sensitive silver halide emulsion layers comprises the silver halide emulsion as described in the paragraph 1 or 2.

In the hexagonal tabular grains contained in the silver halide emulsion of the present invention (hereinafter often simply "the tabular gains of the present invention"), what is meant by "hexagon" is a hexagon wherein the ratio of the length of a side with a length maximum to the length of a side with a minimum length is 2 or less and the straight line ratio of the hexagon is 4/5 or more. The aspect ratio refers to the ratio of diameter to thickness of a grain. The diameter of a silver halide grain refers to the diameter of a circle having an area equal to a projected area of the grain. The thickness refers to the distance between two parallel faces that form a tabular silver halide grain.

The hexagonal tabular grains used in the present invention have a diameter of 0.2 μm or more, preferably from 0.3 μm to 3.0 μm, and more preferably from 0.5 μm to 1.7 μm.

The tabular grains used in the present invention have a thickness of 0.3 μm or less, preferably from 0.05 μm to 0.3 μm, and more preferably from 0.1 μm to 0.3 μm.

The tabular grains used in the present invention have a longest distance between twin planes of individual silver halide grains, of 100 Å or less, and preferably from 10 Å to 100 Å, on the average (i.e., average longest distance between twin planes). Herein the longest distance between twin planes refers to the distance between two twin planes in the case of a grain having two twin planes. In the case of a grain having twin planes more than two, it refers to the longest distance among distances between two twin planes adjacent to each other. The average longest distance between twin planes is meant by a value obtained by measuring longest distances between twin planes on 100 or more grains and averaging the measurements.

The twin plane can be observed using a transmission electron microscope. For example, the emulsion comprising tabular grains is coated on a support to prepare a sample so as for the grains to be oriented substantially in parallel on the support, and thereafter the sample is cut with a diamond knife to give thin sections in a thickness of about 0.1 μm. Observation of the resulting sections using a transmission electron microscope can confirm the presence of twin plane.

The distance between twin planes can be changed by controlling factors having an influence on the state of supersaturation during the formation of nuclei, as exemplified by factors such as gelatin concentration, temperature, iodide ion concentration, pBr, ion feed rate, stirring revolution number and gelatin species. In general, when grains with a small distance between twin planes are prepared, it is important to form nuclei in a highly supersaturated state and over a short period time.

The tabular grains of the present invention may have an average aspect ratio of 7 or less, preferably from 2 to 7, and more preferably from 3 to 7. Herein the average aspect ratio refers to a number average of aspect ratios of individual tabular grains.

With regard to the proportion of the hexagonal tabular silver halide grains held in the emulsion containing the tabular grains of the present invention, it may be 50% or more, and preferably 70% or more, based on the whole projected areas.

The silver halide emulsion of the present invention may preferably be a monodisperse emulsion having a narrow grain size distribution.

Herein the monodisperse silver halide emulsion may preferably be an emulsion in which the weight of silver halides included within the grain size region of ±20% around an average grain size r comprises at least 60%, more preferably at least 70%, and still more preferably at least 80%, of the weight of the whole silver halide grains.

Herein the average grain size is defined to be grain diameter ri obtained when the product ni of frequency ni of grains having a grain diameter ri, and $ri^3$, i e $ni \times ri^3$ comes to be maximum (effective number: 3 figures; minimum figure number is rounded off).

The grain diameter herein referred to is the diameter of a circle having the area equal to the projected area of the grain, as previously stated.

The grain diameter can be obtained, for example, by photographing the grains under magnification of 10,000 to 70,000 times using an electron microscope, and actually measuring the diameters of the grains on a print thereof or their areas when projected. (The number of grains measured should be 1,000 or more at random.)

In the present invention, a monodisperse emulsion with a particularly preferable monodispersity is an emulsion having a breadth of distribution of 30% or less, and more preferably 25% or less, when the breadth of distribution is defined by:

Standard deviation/average grain size ×100 =Breadth of distribution (%)

Here, the average grain size and standard deviation are determined from the grain diameter ri previously defined.

As a method of obtaining a more highly monodisperse emulsion, the method of growth in the presence of tetrazaindene as disclosed in Japanese Patent O.P.I. Publication No. 122935/1985 can be applied.

The silver halide photographic emulsion of the present invention comprises core/shell grains having at least one layer of shell comprising silver iodobromide silver bromide.

The core/shell grains contained in the emulsion of the present invention are grains comprised of a core and a shell that covers the core. The shell is formed in one layer or more layers. The core and shell may preferably have a silver iodide content different from each other, and particularly preferably the grains may be so formed as to have a highest silver iodide content at the core.

In the present invention, the core has a silver iodide content of not less than 7 mol %, preferably from 10 to 40 mol %, and more preferably from 15 to 40 mol %. The shell or the outermost shell among the shells, i.e., a shell that forms the outermost surface layer, has a silver iodide content of not more than 4 mol %, and preferably from 3 to 0 mol %.

The core may preferably be held in the whole grain in a proportion of from 2 to 60%, and more preferably from 5 to 50%.

In the present invention, in the case when the core and shell have a silver iodide content different from each other, the difference in silver iodide content between the core having a higher content and the shell having a lower content should lead to a sharp boundary. An intermediate layer having a medium silver iodide content with respect to the core and the outermost shell may be interposed between the core and the shell. Such grains may also be preferably used.

In the case when the emulsion of the present invention contains the core/shell silver halide grains having the above intermediate layer, the intermediate layer may preferably be in a volume of from 1 to 30%, and more preferably from 5 to 20%, of that of the whole grain.

The difference in silver iodide content between the shell and intermediate layer, and between the intermediate layer and core may preferably be not less than 3 mol %.

The silver halide emulsion of the present invention may preferably have an average silver iodide content of not less than 3 mol %, and more preferably from 4 to 15 mol %.

The individual grains in the silver halide emulsion of the present invention may have the silver iodide content in a relative standard deviation of 20% or less, and preferably 15% or less. The silver iodide content of individual grains can be measured using, for example, an X-ray microanalyzer. The relative standard deviation herein used refers to a value made by multiplying by 100 a value given by dividing a standard deviation in the measurements of silver iodide content in 100 emulsion grains, by the average silver iodide content.

The silver halide emulsion of the present invention is an emulsion mainly containing silver iodobromide. It may contain a silver halide with other composition, for example, silver chloride so long as the effect of the present invention is not impaired.

Part or the whole of the silver halide emulsion of the present invention may be formed by feeding at least one kind of emulsion comprised of fine-size silver halide grains (hereinafter often simply "fine-grain emulsion").

The fine-grain emulsion may be of any halogen composition including silver bromide, silver iodide and silver iodobromide. Any of them may be used in any desired combination according to the halogen composition intended for the silver halide emulsion of the present invention, preferably a combination of silver iodide with silver iodobromide containing not more than 3 mol % of silver iodide, and more preferably a combination of silver iodide with silver bromide. So long as the effect of the present invention is not impaired, a fine-grain emulsion comprising any one of silver chloride, silver iodochloride, silver chlorobromide and silver iodochlorobromide or a combination of any of these may also be fed.

The fine-grain emulsion may preferably have a grain diameter of 0.1 μm or less, more preferably 0.07 μm or less, and particularly preferably 0.05 μm or less.

The silver halide emulsion of the present invention can be formed by a method including the following two methods.

(a) The fine-grain emulsion is formed in a mixer and immediately thereafter it is added in a reaction vessel.

(b) The fine-grain emulsion is previously prepared and is added to a reaction vessel.

In the present invention, either of the methods (a) and (b) may be used.

The silver halide emulsion of the present invention is obtained by previously putting in a reaction vessel an aqueous solution containing a protective colloid, and optionally a seed emulsion, and feeding therein the fine-grain emulsion and optionally silver ions and halide ions to carry out formation of nuclei or crystal growth of the seed emulsion. On that occasion, it is possible to use in combination a method in which the pAg and pH in the liquid phase where silver halides are formed are controlled in accordance with the growth rate of the silver halides.

Here the seed emulsion can be prepared by the single jet precipitation or controlled double-jet precipitation well known in the present technical field.

The seed emulsion may be of any composition, including silver bromide, silver iodide, silver chloride, silver iodobromide, silver chloroiodobromide, silver iodochloride and silver chloroiodobromide. Silver bromide and silver iodochlorobromide are preferred.

In the present invention, the aqueous solution containing a protective colloid is meant to be an aqueous solution in which a protective colloid has been formed by gelatin or other substance capable of forming a hydrophilic colloid, e.g., a substance capable of serving as a binder. It may preferably be an aqueous solution containing a colloidal protective gelatin.

In working the present invention, when gelatin is used as the protective colloid, the gelatin may be either lime-treated gelatin or gelatin treated with an acid. Preparation method of gelatin is detailed in Arther Vise, The Macromolecular Chemistry of Gelatin, Academic Press, published 1964.

The hydrophilic colloid other than the gelatin, usable as the protective colloid, includes various synthetic hydrophilic polymeric substances as exemplified by gelatin derivatives, graft polymers of gelatin with other macromolecules, proteins such as albumin and casein, cellulose derivatives such as hydroxyethyl cellulose, carboxymethyl cellulose and cellulose sulfuric esters, sugar derivatives such as sodium alginate and starch derivatives, and homopolymers such as polyvinyl alcohol, polyvinyl alcohol partial acetal, poly-N-vinyl pyrrolidone, polyacrylic acid, polymethacrylic acid, polyacrylamide, polyvinyl imidazole and polyvinyl pyrazole, or copolymer thereof.

In the case of gelatin, it is preferable to use gelatin having a jelly strength of 20 or more as measured by the PAGI method.

The gelatin added in the preparation of the emulsion concerned with the present invention, in particular, in the course of the growth of the core, may preferably be in an amount not less than 0.5% by weight, particularly preferably not less than 1.0% by weight.

The silver halide emulsion of the present invention, part or the whole thereof, is formed by feeding at least one kind of fine-grain emulsion to cause formation of nuclei or crystal growth of the seed emulsion. The proportion in which the silver halide emulsion of the present invention is formed using the fine-grain emulsion may preferably be not less than 5 mol %, and more preferably from 15 to 100 mol %, provided that the weight of silver held by the seed emulsion with respect to the silver halide emulsion of the present invention is excluded.

During the preparation of the silver halide emulsion of the present invention, a known silver halide solvent such as ammonia, thioether or thiourea may be made present, or the silver halide solvent need not be used.

In the course of the formation and/or growth of grains, metal ions may be added to the silver halide grains by the use of at least one selected from a cadmium salt, a zinc salt, a lead salt, a thallium salt and an iridium salt (including complex salts) so that any of these metal elements can be incorporated in grain insides and/or grain surfaces. The silver halide grains may also be placed in an appropriate reducing atmosphere so that reducingly sensitizing nuclei can be imparted to the grain insides and/or grain surfaces.

The silver halide grains may be either those in which a latent image is mainly formed on the surfaces or those in which it is mainly formed in the insides of grains.

From the emulsion according to the present invention, excess soluble salts may be removed after the growth of the silver halide grains has been completed, or they may remain unremoved. In the case when the slats are removed, they can be removed by the method described in Research Disclosure No. 17643, paragraph II.

More particularly, in order to remove the soluble salts from the emulsion having been subjected to precipitate formation or physical ripening, desalting may be carried out using noodle washing which is carried out by setting gelatin to gel, or by flocculation that utilizes an inorganic salt, an anionic surface active agent, an anionic polymer as exemplified by polystyrene sulfonate or a gelatin derivative as exemplified by acylated gelatin or carbamoylated gelatin.

The emulsion according to the present invention can be chemically sensitized.

There are no particular limitations on the conditions such as pH, pAg, temperature, time and additives in the step of chemical ripening, i.e., chemical sensitization. The chemical sensitization can be carried out under conditions commonly employed in the present industrial field.

For the purpose of the chemical sensitization, the sulfur sensitization making use of a compound containing sulfur capable of reacting with silver ions or an active gelatin, the selenium sensitization making use of a selenium compound, the reduction sensitization making use of a reducing substance and the noble metal sensitization making use of a compound of noble metal such as gold or the like can be used alone or in combination.

In the sulfur sensitization, known sulfur sensitizers can be used. For example, thiosulfates, allylthiocarbamides, thioureas, allylisothiocyanates, cystine, p-toluene thiosulfonates and rhodanine can be used. Besides, it is also possible to use the sulfur sensitizers disclosed in U.S. Pat. Nos. 1,574,944, 2,410,689, 2,278,947, 2,728,668, 3,501,313 and 3,656,955, West German Laid-open Application (OLS) No. 14 22 869, and Japanese Patent O.P.I. Publications No. 24937/1981 and No. 45016/1980.

The sulfur sensitizer may be added in an amount necessary for effectively increasing the sensitivity of the emulsion. This amount may vary over a considerable range depending on the amount of other additives used during the chemical sensitization, the pH, the temperature and the silver halide grain size. As a standard, the sulfur sensitizer may preferably be added in an amount of from about $10^{-7}$ mol to about $10^{-1}$ mol per mol of silver halide.

Selenium sensitizers may be used in place of the sulfur sensitizers. Usable selenium sensitizers may include aliphatic isoselenocyanates such as allylisocyanate, selenoureas, selenoketones, selenoamides, selenocarboxylic acid salts or esters, selenophosphates, and selenides such as diethyl selenide and diethyl diselenide. Examples of these are disclosed in U.S. Pat. Nos. 1,574,944, 1,602,592 and 1,623,499.

The amount of the selenium sensitizer may also vary over a wide range similar to that of the sulfur sensitizers. As a standard, the selenium sensitizer may preferably be added in an amount of from about $10^{-7}$ mol to about $10^{-1}$ mol per mol of silver halide.

In the case when gold sensitizers are used in the present invention, the valence number of the gold may be +1 or +3, and many kinds of gold compounds can be used. Typical examples thereof are chloroauric acid, potassium chloroaurate, auric trichloride, potassium auric thiocyanate, potassium iodoaurate, tetracyanoauric azide, ammonium aurothiocyanate and pyridyl trichlorogold.

The amount of the gold sensitizer may vary depending on various conditions. As a standard, it may preferably be in the range of from about $10^{-7}$ to about $10^{-1}$ mol per mol of silver halide.

A compound capable of releasing gold from gold-gelatinate and also promoting the adsorption of gold ions to silver halide grains may be used. Such a compound may preferably be a complex compound of Rh, Pd, Ir or Pt, represented by $R_2MX_4$, $R_3MX_6$ or $MX_6$, wherein R represents a hydrogen atom, an ammonium group or an alkali metal salt, M represents Pt, Pd, Ir or Rh, and X represents a halogen atom.

Specific compounds may include $(NH_4)_2PtCl_4$, $(NH_4)_2PdCl_4$, $K_2(IrBr_6)$, $(NH_4)_3RhCl_6.12H_2O$. Particularly preferred are ammonium tetrachloroparadate (II) $(NH_4)_2PtCl_4$. It may be added in an amount ranging 10 to 100 times the gold sensitizer in terms of stoichiometric ratio (molar ratio).

Such a compound may be added at the start of chemical ripening, in the course of chemical ripening, or after completion of chemical ripening. It may preferably be added in the course of the chemical ripening, and may particularly preferably be added at the same time as the addition of the gold sensitizer, or before or after that time.

In working the present invention, a reduction sensitizer may preferably be used in combination. As a reducing agent, there are no particular limitations. It may include known stannous chloride, thiourea dioxide, hydrazine derivatives and polyamines.

In the case when the reduction sensitization is carried out, it is usually carried out during the growth of silver halide grains, and may preferably be carried out after chalcogen sensitization, gold sensitization and sensitization using a compound selected from noble metal compounds such as Rh, Pd, Ir and Pt have been completed.

The silver halide emulsion may be optically sensitized to the desired wavelength region. There are no particular limitations on the manner by which the optical sensitization is applied. For example, the optical sensitization (e.g., supersensitization) may be carried out using alone or in combination, a spectral sensitizer including a cyanine dye or merocyanine dye such as a xeromethine dye, a monomethine dye, a dimethine dye or a trimethine dye.

These techniques are disclosed in U.S. Pat. Nos. 2,688,545, 2,912,329, 3,397,060, 3,615,635 and 3,628,946, British Patents Nos. 1,195,302, 1,242,588 and 1,293,862, German Patent Publications (OLS) No. 20 30 326 and No. 21 21 780 and Japanese Patent Examined Publications No. 4936/1968 and No. 14030/1968. They may be optionally selected according to the wavelength region to which silver halide grains are to be sensitized, the sensitivity or the like and the purposes and uses of light-sensitive materials.

Such spectral sensitizers may be added at any time during the preparation of the emulsion, e.g., during the crystal growth, after completion of the formation of crystals and before desalting, in the course of desalting, before or after addition of the chemical sensitizer, before or after completion of the chemical sensitization, before or after preparation of coating solutions, or immediately before coating.

In working the present invention, various additives may be incorporated in the silver halide emulsion for the purpose of preventing fog from occurring during its preparation, storage or photographic processing, or stabilizing photographic performances.

For example, it is possible to add various compounds known as antifoggants or stabilizers as exemplified by azoles, benzothiazolium salts, nitroindazoles, nitrobenzimidazoles, chlorobenzimidazoles, bromobenzimidazoles, mercaptothiazoles, mercaptobenzimidazoles, aminotriazoles, benzotriazoles, nitrobenzotriazoles, and mercaptotetrazoles, in particular, 1-phenyl-5-mercaptotetrazole, as well as mercaptopyrimidines, mercaptotriazines, thioketone compounds as exemplified by oxazolinethione, and also benzenethiosulfinic acid, benzenesulfinic acid, benzenesulfonamide, hydroquinone derivatives, aminophenol derivatives, gallic acid derivatives and ascorbic acid derivatives. Any of these compounds may preferably be added to the silver halide emulsion during the chemical ripening or before its coating on a support.

As the dispersion medium referred to in the present invention, gelatin may preferably be used. As the gelatin, a modified gelatin such as alkali-treated gelatin, acid-treated gelatin, low-molecular weight gelatin (those having a molecular weight of from 2,000 to 100,000) or phthalated gelatin may be used. Other hydrophilic colloid may also be used.

Stated specifically, it may include the hydrophilic colloid as described in the present specification or those described in Research Disclosure Vol. 176, No. 17643 (December, 1978), paragraph IX.

The silver halide emulsion may contain every sort of binder. In the case when gelatin is contained as the binder, usual gelatin for photographic use is preferred as the gelatin. Not only the gelatin but also a gelatin derivative may also be used. The gelatin derivative includes reaction products of gelatin with an acid anhydride, reaction products of gelatin with an isocyanate and reaction products of gelatin with a compound having an active halogen atom. The acid anhydride used here in its reaction with gelatin may include, for example, maleic anhydride, phthalic anhydride, benzoic anhydride, acetic anhydride, isatoic anhydride and succinic anhydride. The isocyanate compound may include, for example, phenyl isocyanate, p-bromophenyl isocyanate, p-chlorophenyl isocyanate, p-tolyl isocyanate, p-nitrophenyl isocyanate and naphthyl isocyanate.

The compound having an active halogen atom may include, for example, benzenesulfonyl chloride, p-methoxybenzenesulfonyl chloride, p-phenoxybenzenesulfonyl chloride, p-bromobenzenesulfonyl chloride, p-toluenesulfonyl chloride, m-nitrobenzenesulfonyl chloride, m-sulfobenzoyl dichloride, naphthalene-β-sulfonyl chloride, p-chlorobenzenesulfonyl chloride, 3-nitro-4-aminobenzenesulfonyl chloride, 2-carboxy-4-bromobenzenesulfonyl chloride, m-carboxybenzenesulfonyl chloride, 2-amino-5-methylbenzenesulfonyl chloride, phthalyl chloride, p-nitrobenzoyl chloride, benzoyl chloride, ethyl chlorocarbonate and furoyl chloride.

In the silver halide emulsion, a hydrophilic colloid other than gelatin can be used as the binder. For example, it is possible to use colloidal albumin, agar, arabic rubber, dextran, alginic acid, cellulose derivatives as exemplified by cellulose acetate hydrolyzed to an acetyl content of 19 to 26%, polyacrylamide, imidized polyacrylamide, casein, urethane carboxylic acid groups as exemplified by a vinyl alcohol-vinyl cyanoacetate copolymer, vinyl alcohol polymers containing a cyanoacetyl group, polyvinyl alcohol-polyvinyl pyrrolidone, hydrolyzed polyvinyl acetate, polymers obtained by polymerization of protein or saturated acylated protein with a monomer having a vinyl group, polyvinyl pyridine, polyvinyl amine, polyaminoethyl methacrylate, or polyethyleneimine.

In the silver halide emulsion layers, a gelatin hardening agent may be used particularly when constituted as emulsion layers. In general, such a hardening agent is an agent that causes cross-linking upon reaction with gelatin and forms an organic or inorganic acid as a by-product when a hardening action is exhibited.

For example, it is possible to use 2,3-dihalogenomalealdehyde-acids capable of releasing a halogenated hydro-acid (U.S. Pat. No. 2,080,019), 2,4-dichloro-s-triazines (U.S. Pat. No. 3,325,287), No. chloropyrimidine derivatives (British Patent No. 1,193,290), polymers containing a chlorotriazine ring in the side chain (U.S. Pat. No. 3,362,827, West German Patent Publication No. 19 21 363), dichlorophosphoamide derivatives (British Patents No. 974,723 and No. 1,004,658), halomethyl derivatives (British Patent No. 990,275), phosphonitrilic chloride derivatives (U.S. Pat. No. 3,186,848) or derivatives of 2-phenoxy-3-halogeno-malealdehyde-acid capable of releasing a phenol derivative (British Patent No. 1,192,775).

The silver halide emulsion may contain various types of known surface active agents particularly when emulsion layers are formed and besides for the various purposes of antistatic, emulsification dispersion, anti-sticking and improvement of photographic performances.

More specifically, it is possible to use, for example, nonionic surface active agents including saponin (asteroid type), alkylene oxide derivatives as exemplified by polyethylene glycol, a polyethylene glycolpolypropylene glycol condensate, a polyethylene glycol alkyl or alkylaryl ether, a polyethylene glycol ester, a polyethylene glycol sorbitan ester, a polyethylene glycol alkylamine or -amide and a polyethylene oxide addition product, glycidol derivatives as exemplified by alkenylsuccinic acid polyglyceride and alkylphenol polyglyceride, fatty acid esters of polyhydric alcohols, alkyl esters of saccarides, urethanes or ethers of the same, triterpenoid saponin, anionic surface active agents containing an acidic group such as a carboxyl group, a sulfo group, a phospho group, a sulfuric ester group or a phosphoric ester group as exemplified by alkylcarboxylates, alkylbenzenesulfonates, alkylnaphthalenesulfonates, alkylsulfuric esters, alkylphosphoric esters, N-acyl-N-alkyltaurines, sulfosuccinic esters, sulfoalkylpolyoxyethylene alkyl phenyl ethers and polyoxyethylene alkylphosphoric esters, amphoteric surface active agents including amino acids, aminoalkylsulfonic acids, aminoalkylsulfuric or -phosphoric esters, alkylbetaines, amine imides and amine oxides, and cationic surface active agents including alkylamines, aliphatic or aromatic quaternary ammonium salts, heterocyclic quaternary ammonium salts such as pyridinium and imidazolium, and aliphatic or heterocyclic ring-containing sulfonium or sulfonium salts; which are disclosed in U.S. Pat. Nos. 2,240,472, 2,831,766, 3,158,484, 3,210,191, 3,294,540 and 3,507,660, British Patent Nos. 1,012,495, 1,022,878, No. 1,179,290 and No. 1,198,450, U.S. Pat. Nos. 2,739,891, 2,823,123, 1,198,450, 2,739,891, 2,823,123, 3,068,101, 3,415,649, 3,666,478 and 3,756,828, British Patents No. 1,397,218, U.S. Pat. Nos. 3,113,816, 3,411,413, 3,473,174, 3,345,974, 3,726,683 and 3,843,368, Belgian Patent No. 731,126, British Patents No. 1,138,514, 1,159,825, No. 1,374,780, U.S. Pat. Nos. 2,271,623, 2,288,226, 2,944,900, 3,235,919, 3,671,247, 3,772,012, 3,589,906, 3,666,478, 3,754,924, West German Patent Application Publication (OLS) No. 19 61 683, Japanese Patent O.P.I. Publications No. 11741/1975 and No. 59025/1975, and Japanese Patent Examined Publications No. 378/1965, No. 379/1965 and No. 13822/1968.

In addition to the surface active agent described above, the silver halide emulsion may also contain a development accelerator including imidazoles, thioethers and selenoethers as disclosed in West German Patent Application Publications (OLS) No. 20 02 871, No. 24 45 611 and No. 23 60 878, and British Patent No. 1,352,196.

In order to apply emulsions obtained by the present invention to color light-sensitive materials, they may be incorporated in a red-sensitive silver halide emulsion layer, a green-sensitive silver halide emulsion layer and a blue-sensitive silver halide emulsion layer in combination with a cyan coupler, a magenta coupler and a yellow coupler, respectively, where methods and materials used in color light-sensitive materials may be applied. The couplers used here should be non-diffusible couplers having a hydrophobic group called a ballast group.

The couplers may be either four-equivalent couplers or two-equivalent couplers. Colored couplers having an effect of color correction or couplers capable of releasing a development restrainer upon development (what is called DIR couplers) may also be contained. The couplers may also be couplers such that products of coupling reaction are colorless.

As the yellow coupler, known closed ketomethylene couplers can be used. Of these, benzoylacetanilide and pivaloylacetanilide compounds are advantageous. Examples of usable yellow couplers are those disclosed in U.S. Pat. Nos. 2,875,057, 3,265,506, 3,408,194, 3,551,155, 3,582,322, 3,725,072 and 3,891,445, West German Patent No. 15 47 868, and West German Patent Application Publications (OLS) No. 22 13 461, No. 22 19 917, No. 22 61 361, No. 24 14 006 and No. 22 63 875.

The magenta coupler that can be used may include compounds of a pyrazolone type, an indazolone type or a cyanoacetyl type. In particular, pyrazolone type compounds are advantageous. Examples of usable magenta color forming couplers are those disclosed in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Patent No. 18 10 464 West German Patent Application Publications (OLS) No. 24 68 865, No. 24 17 945, No. 24 18 959, No. 24 24 467, and Japanese Patent Examined Publication No. 6031/1965;

As the cyan coupler, phenol type compounds and naphthol type compounds can be used. Examples thereof are those disclosed in U.S. Pat. Nos. 2,369,929, 2,434,272, 2,474,293, 2,521,908, 2,895,826, 3,034,892, 3,311,476, 3,458,315, 3,476,563, 3,583,971, 3,591,383 and 3,767,411, West German Patent Application Publications (OLS) No. 24 14 830 and No. 24 54 329, and Japanese Patent O.P.I. Publication No. 59838/1973.

Colored couplers that can be used are exemplified by those disclosed in U.S. Pat. Nos. 3,476,560, 2,521,908 and 3,034,892, Japanese Patent Examined Publication No. 2016/1969, No. 22335/1963, No. 11304/1967 and No. 32461/1969, and West German Patent Application Publication (OLS) No. 24 18 959.

DIR couplers that can be used are exemplified by those disclosed in U.S. Pat. Nos. 3,227,554, 3,617,291, 3,701,783, 3,790,384 and 3,632,345, West German Patent Application Publications (OLS) No. 24 14 006, No. 24 54 301 and No. 24 54 329, and British Patent No. 953,454.

Other than the DIR couplers, a compound capable of releasing a development restrainer upon development may also be contained in the light-sensitive material, and those disclosed in U.S. Pat. Nos. 3,297,445 3,379,529 and West German Patent Application Publication (OLS) No. 24 17 914 can be used. Besides these, it is possible to use couplers disclosed in Japanese Patent O.P.I. Publications No. 85549/1980, No. 94752/1982, No. 65134/1981, no. 135841/1981, No. 13071/1979, No. 133734/1981 and No. 135841/1981, U.S. Pat. No. 4,310,618, British Patent No. 2,083,640, Research Disclosures 18360 (1979), 14850 (1980), 19033 (1980), 19146(1980), 20252(1981) and 21728(1982).

Two or more kinds of couplers described above may be contained in the same layer. The same kind of compounds may also be contained in two or more layers.

The couplers can be introduced into the light-sensitive silver halide emulsion layers by known methods as exemplified by the method disclosed in U.S. Pat. No. 2,322,027. For example, the couplers are dissolved in a phthalic acid alkyl ester such as dibutyl phthalate or dioctyl phthalate, a phosphoric ester such as diphenyl phosphate, triphenyl phosphate, tricresyl phosphate or dioctylbutyl phosphate, a citric ester such as tributyl acetylacetate, a benzoic ester such as octyl benzoate or an alkylamide such as diethyllaurylamide, or an organic solvent having a boiling point of from 30° C. to 150° C. as exemplified by a lower alkyl acetate such as butyl acetate and also exemplified by ethyl propionate, secondary butyl alcohol, methyl isobutyl ketone, β-ethoxyethyl alkyleneacetate or methyl cellosolve acetate, and thereafter dispersed in a hydrophilic colloid. The above high-boiling organic solvent and low-boiling organic solvent may be used in the form of a mixture of them.

In instances in which the couplers have an acidic group such as carboxylic acid or sulfonic acid, they are introduced into the hydrophilic colloid in the form of an aqueous alkaline solution.

These couplers should be added in the light-sensitive silver halide emulsion layers usually in an amount of preferably from $2\times10^{-3}$ to $5\times10^{-1}$ mol, and more preferably from $1\times10^{-2}$ to $5\times10^{-1}$, per mol of silver halide.

A hydroquinone derivative, an aminophenol derivative, a gallic acid derivative, an ascorbic acid derivative or the like may also be contained as an anti-color-foggant Examples thereof are disclosed in U.S. Pat. Nos. 2,360,290, 2,336,327, 2,403,721, 2,418,613, 2,675,314, 2,701,197, 2,704,713, 2,704,713, 2,728,659, 2,732,300 and 2,735,765, Japanese Patent O.P.I. Publications No. 92988/1975, No. 92989/1975, No. 93928/1975 and No. 110337/1975, and Japanese Patent Examined Publication No. 23813/1975.

As an antistatic agent, it is effective to use an alkali salt of a reaction product of diacetyl cellulose, a styrene-perfluoroalkyl sodium maleate copolymer or a styrene-maleic anhydride copolymer with p-aminobenzene sulfonic acid. A matting agent may include polymethyl methacrylate, polystyrene and alkali-soluble polymers. It is also possible to use colloidal silicon oxide.

A latex added to improve coating properties may include copolymers of an acrylic ester or vinyl ester with a monomer having other ethylene group. A gelatin plasticizer may include glycerol and glycol type compounds. A thickening agent may include a styrene-sodium maleate copolymer and an alkyl vinyl ether-maleic acid copolymer.

The support on which the emulsion obtained by the present invention is coated to form the light-sensitive material may include, for example, baryta paper, polyethylene-coated paper, polypropylene synthetic paper, glass sheets, cellulose acetate films, cellulose nitrate films, polyvinyl acetal films, polypropylene films, polyester films as exemplified by polyethylene terephthalate film, and polystyrene films. These supports are appropriately selected according to the purpose for which light-sensitive materials are used.

These supports may be optionally subjected to subbing treatment.

The light-sensitive material making use of the emulsion obtained by the present invention, having been exposed, can be photographically processed by known methods usually used.

A black and white developing solution is an alkali solution containing a developing agent including hydroxybenzenes, aminophenols and aminobenzenes. It may also contain alkali metal salt sulfite, carbonate, bisulfite, bromide and iodide.

In the case when the light-sensitive material is a color light-sensitive material, color developing can be carried out by color developing methods usually used. In reversal development, the light-sensitive material is first processed using a black and white negative developing solution, and then exposed to white light or processed using a bath containing a fogging agent, followed by further processing with an alkali developing solution containing a color developing agent, to effect color development.

There are no particular limitations on the processing methods, and all processing methods can be applied. As typical examples thereof, it is possible to apply a method in which, after color developing, bleach-fixing is carried out and optionally washing and stabilizing are further carried out, or a method in which, after color developing, fixing and bleaching are separately carried out and optionally washing and stabilizing are further carried out.

Such light-sensitive materials can be applied to many uses. For example, they can be applied to a variety of uses for black and white general purpose, X-ray photography, color photography, infrared photography, microphotography, silver dye bleach process, reversal process, diffusion transfer process and so forth.

When applied in multi-layer color light-sensitive materials, various layer structures well known in the present industrial field, i.e, a conventional layer order, an inverted layer structure and other all layer structures can be applied.

EXAMPLES

The present invention will be described below in greater detail. The present invention is by no means limited by these Examples.

Example 1

Preparation of seed emulsion EM-A:

A silver iodobromide emulsion containing 6.0 mol % of silver iodide was prepared in the following way. In an aqueous solution being stirred, containing 0.5% by weight of gelatin, an aqueous solution of silver nitrate and an aqueous solution of a mixture of potassium iodide and potassium bromide were added by double-jet precipitation over a period of 2 minutes under conditions of 60° C, a pH of 2.0 and a pAg of 9.02 to effect formation of nuclei. Thereafter, the emulsion was adjusted to have a pH of 6.0 and ripened for 10 minutes, followed by washing with water to remove excess salts. Emulsion EM-A thus obtained was a seed emulsion containing hexagonal tabular grains with an average grain diameter of 0.5 μm and an average thickness of 0.07 μm. Emulsion EM-A was also an emulsion containing silver in an amount corresponding to 1,200 g in terms of silver nitrate, which was in a finish amount of 4,160 g.

Preparation of seed emulsion EM-B:

Seed emulsion EM-B was prepared in the same manner as the seed emulsion EM-A except that the ripening time, 10 minutes, used therein was extended to 20 minutes. The emulsion thus obtained was a seed emulsion containing hexagonal tabular grains with an average grain diameter of 0.48 μm and an average thickness of 0.08 μm.

Preparation of seed emulsion EM-C:

Seed emulsion EM-C was prepared in the same manner as the seed emulsion EM-A except that the nuclei forming time, 2 minutes, used therein was shortened to 10 seconds. The emulsion thus obtained was a seed emulsion containing hexagonal tabular grains with an average grain diameter of 0.46 μm and an average thickness of 0.08 μm.

Preparation of comparative emulsions EM-1 to EM-6:

To 9,000 ml of aqueous 3.0% by weight gelatin solution, which was kept at a temperature of 60° C, a pAg of 8.82 and a pH of 6.0, 449.2 g of seed emulsion EM-A was added with thorough stirring. Thereafter, an aqueous solution containing 4.32 mol of silver nitrate and an aqueous solution containing 0.173 mol of potassium iodide and 4.15 mol of potassium bromide were added over a period of 22 minutes in an amount of 1,234 ml each. Subsequently an aqueous solution containing 1.98 mol of silver nitrate and an aqueous solution containing 0.0396 mol of potassium iodide and 1.94 mol of potassium bromide were added in an amount of 566 ml each.

Thereafter, desalinization was carried out by a conventional method to remove excess salts, followed by addition of gelatin. The emulsion was made up to 3,000 ml in its total volume, and made to have a pH of 5.8 and a pAg of 8.06 as values measured at 40° C. This is designated as comparative emulsion EM-1.

In the preparation of emulsion EM-1, the seed emulsion, pAg, core/shell iodide composition, addition flow rate and so forth were changed. Comparative emulsions EM-2 to EM-6 were thus prepared as shown in Table 1.

Preparation of emulsions EM-7 to EM-10 of the present invention:

To 9,000 ml of aqueous 3.0% by weight gelatin solution, which was kept at a temperature of 60° C., a pAg of 8.82 and a pH of 6.0, 449.2 g of seed emulsion EM-C was added with thorough stirring. Thereafter, an aqueous solution containing 1.64 mol of silver nitrate and an aqueous solution containing 0.328 mol of potassium iodide and 1.31 mol of potassium bromide were added over a period of 20 minutes in an amount of 469 ml each. Subsequently an aqueous solution containing 2.68 mol of silver nitrate and an aqueous solution containing 0.0536 mol of potassium iodide and 2.63 mol of potassium bromide were added in an amount of 766 ml each.

Thereafter, an aqueous solution containing 1.98 mol of silver nitrate and an aqueous solution containing 1.98 mol of potassium bromide were added in an amount of 566 ml each.

Thereafter, desalinization was carried out by a conventional method to remove excess salts, followed by addition of gelatin. The emulsion was made up to 3,000 ml in its total volume, and made to have a pH of 5.8 and a pAg of 8.06 as values measured at 40° C. This is designated as emulsion EM-7.

In the preparation of emulsion EM-7, the pAg was changed. Emulsions EM-8 to EM-10 were thus prepared.

Preparation of fine-grain silver bromide emulsion EM-D:

To 7,700 ml of an aqueous 6.2% by weight gelatin solution containing 0.003 mol of potassium iodide, an aqueous solution containing 10.6 mol of silver nitrate and an aqueous solution containing 10.6 mol of potassium bromide were added in an amount of 3,500 ml each, at constant flow rates over a period of 11 minutes. In the course of the preparation of fine grains, the temperature was kept at 30° C. The resulting fine silver iodide grains were confirmed on an electron microscope photograph of 60,000 magnifications to reveal that the grains had an average grain size of 0.035 μm. This fine-grain silver bromide emulsion is designated as EM-D.

Preparation of fine-grain silver iodide emulsion EM-E:

To 1,000 ml of an aqueous 5.0% by weight gelatin solution containing 0.008 mol of potassium iodide, an aqueous solution containing 1.06 mol of silver nitrate and an aqueous solution containing 1.06 mol of potassium iodide were added in an amount of 300 ml each, at constant flow rates over a period of 35 minutes. In the course of the preparation of fine grains, the temperature was kept at 40° C. The resulting fine silver iodide grains were confirmed on an electron microscope photograph of 60,000 magnifications to reveal that the grains had an average grain size of 0.06 μm. This fine-grain silver iodide emulsion is designated as EM-E.

Preparation of emulsions EM-11 to EM-12 of the present invention:

To 9,000 ml of aqueous 3.0% by weight gelatin solution, which was kept at a temperature of 60° C., a pAg of 8.82 and a pH of 6.0, 449.2 g of seed emulsion EM-C was added with thorough stirring. Thereafter, an aqueous solution containing 1.31 mol of silver nitrate, an aqueous solution containing 1.31 mol of potassium bromide and fine-grain silver iodide emulsion EM-E in an amount corresponding to 0.328 mol were added over a period of 30 minutes. In the course of this addition, the molar ratio of the addition flow rate of the aqueous potassium bromide solution to that of the fine-grain silver iodide emulsion EM-E was kept at 4.0:1.0.

Subsequently, an aqueous solution containing 2.63 mol of silver nitrate, an aqueous solution containing 2.63 mol of potassium bromide and fine-grain silver iodide emulsion EM-E in an amount corresponding to 0.0536 mol were added over a period of 10 minutes. In the course of this addition, the molar ratio of the addition flow rate of the aqueous potassium bromide solution to that of the fine-grain silver iodide emulsion EM-E was kept at 98:2. Thereafter, an aqueous solution containing 1.98 mol of silver nitrate and an aqueous solution containing 1.98 mol of potassium bromide were added in an amount of 566 ml each.

Thereafter, desalinization was carried out by a conventional method to remove excess salts, followed by addition of gelatin. The emulsion was made up to 3,000 ml in its total volume, and made to have a pH of 5.8 and a pAg of 8.06 as values measured at 40° C. This is designated as emulsion EM-11.

In the preparation of emulsion EM-7, the molar ratio of the addition flow rate of the aqueous potassium bromide solution to that of the fine-grain silver iodide emulsion EM-E were changed and also the flow rates of all the solutions added were changed. Emulsion EM-12 was thus prepared.

Preparation of emulsion EM-13 of the present invention:

To 9,000 ml of aqueous 3.0% by weight gelatin solution, which was kept at a temperature of 60° C., a pAg of 8.82 and a pH of 6.0, 449.2 g of seed emulsion EM-B was added with thorough stirring. Thereafter, fine-grain silver bromide emulsion EM-D in an amount corresponding to 1.31 mol and fine-grain silver iodide emulsion EM-E in an amount corresponding to 0.328 mol were added over a period of 40 minutes. In the course of this addition, the molar ratio of the addition flow rate of the fine-grain silver bromide emulsion EM-D to that of the fine-grain silver iodide emulsion EM-E was kept at 4.0:1.0.

Subsequently, fine-grain silver bromide emulsion EM-D in an amount corresponding to 2.63 mol and fine-grain silver iodide emulsion EM-E in an amount corresponding to 0.0136 mol were added over a period of 15 minutes. In the course of this addition, the molar ratio of the addition flow rate of the fine-grain silver bromide emulsion EM-D to that of the fine-grain silver iodide emulsion EM-E was kept at 98:2. Thereafter, fine-grain silver iodide emulsion EM-D in an amount corresponding to 1.98 mol was added over a period of 10 minutes.

Thereafter, desalinization was carried out by a conventional method to remove excess salts, followed by addition of gelatin. The emulsion was made up to 3,000 ml in its total volume, and made to have a pH of 5.8 and a pAg of 8.06 as values measured at 40° C. This is designated as emulsion EM-13.

In the emulsions EM-1 to EM-13 thus obtained, with regard to grains having grain diameter of 0.2 μm or more, their average diameter, average thickness and average aspect ratio, the proportion of projected areas held by hexagonal tabular grains with respect to the total of the projected areas of the whole grains in the emulsion, the average value of the longest distances between twin planes, the core/shell silver iodide content, the average silver iodide content in the whole grains, and the relative standard deviation of silver iodide content in individual grains were measured to obtain the results as shown in Table 1.

TABLE 1

| Emulsion | Remarks | Seed emulsion | Average grain size (μm) | Average thickness (μm) | Average aspect ratio | Average longest distance between twinned-crystal faces (μm) | Projected area percentage (%) | Core/shell silver iodide content (mol %) | Average silver iodide content (mol %) | Silver iodide content average standard deviation (%) |
|---|---|---|---|---|---|---|---|---|---|---|
| EM-1 | X | EM-A | 0.91 | 0.20 | 4.33 | 170 | 43 | 6/4/2 | 3.4 | 22 |
| EM-2 | X | EM-A | 0.91 | 0.19 | 5.50 | 160 | 45 | 6/20/2/0 | 6.1 | 24 |
| EM-3 | X | EM-B | 0.92 | 0.18 | 3.98 | 170 | 88 | 6/20/2/0 | 6.1 | 20 |
| EM-4 | X | EM-B | 0.93 | 0.19 | 4.16 | 160 | 91 | 6/4/2 | 3.4 | 17 |
| EM-5 | X | EM-B | 1.10 | 0.14 | 8.22 | 160 | 87 | 6/20/2/0 | 6.1 | 18 |
| EM-6 | X | EM-C | 0.91 | 0.35 | 4.50 | 70 | 92 | 6/3 | 5.8 | 17 |
| EM-7 | Y | EM-C | 1.08 | 0.15 | 7.52 | 70 | 91 | 6/20/2/0 | 6.1 | 19 |
| EM-8 | Y | EM-C | 0.70 | 0.29 | 2.31 | 60 | 88 | 6/20/2/0 | 6.1 | 17 |
| EM-9 | Y | EM-C | 0.92 | 0.19 | 4.73 | 70 | 87 | 6/20/2/0 | 6.1 | 19 |
| EM-10 | Y | EM-C | 1.05 | 0.14 | 6.88 | 60 | 90 | 6/20/2/0 | 6.1 | 18 |
| EM-11 | Y | EM-C | 0.90 | 0.21 | 4.22 | 60 | 87 | 6/20/2/0 | 6.1 | 13 |
| EM-12 | Y | EM-C | 0.84 | 0.23 | 3.73 | 60 | 91 | 6/20/2/0 | 6.1 | 15 |
| EM-13 | Y | EM-C | 0.91 | 0.21 | 4.45 | 70 | 89 | 6/20/2/0 | 6.1 | 10 |

X: Comparative Example, Y: Present Invention

Example 2

The emulsions EM-1 to EM-13 were subjected to gold-sulfur sensitization to an optimum. Using the resulting emulsions, layers composed as shown below were successively formed from the support side on a triacetyl cellulose film support. Thus, samples of multi-layer color light-sensitive photographic materials were produced.

In the following, the amount of each compound added in the light-sensitive silver halide photographic material is indicated as gram per 1 $m^2$ unless particularly noted. The amounts of silver halide and colloidal silver are in terms of silver weight. Those of spectral sensitizers are each indicated as mole per mol of silver in the same layer.

| Sample 201 | |
|---|---|
| First layer: Anti-halation layer | |
| Black colloidal silver | 0.18 |
| Ultraviolet absorbent UV-1 | 0.23 |
| High-boiling solvent Oil-1 | 0.20 |
| Gelatin | 1.46 |
| Second layer: First intermediate layer | |
| Gelatin | 1.30 |
| Third layer: | |
| Low-speed red-sensitive emulsion layer Silver iodobromide emulsion (average grain size: 0.27 μm; average silver iodide content: 4 mol %) | 0.80 |
| Spectal sensitizer SD-1 | $8.0 \times 10^{-4}$ |
| Spectral sensitizer SD-2 | $6.4 \times 10^{-4}$ |
| Cyan coupler C-1 | 0.60 |
| Colored cyan coupler CC-1 | 0.10 |
| DIR compound DD-1 | 0.05 |
| DIR compound DD-3 | 0.004 |
| High-boiling solvent Oil-1 | 0.50 |
| Gelatin | 0.90 |
| Fourth layer: | |
| High-speed red-sensitive emulsion layer Silver iodobromide emulsion (average grain size: 0.38 μm; average silver iodide content: 6 mol %) | 1.00 |
| Spectral sensitizer SD-1 | $2.5 \times 10^{-4}$ |
| Spectral sensitizer SD-2 | $2.0 \times 10^{-4}$ |
| Cyan coupler C-1 | 0.10 |
| Colored cyan coupler CC-1 | 0.01 |
| DIR compound DD-1 | 0.03 |
| DIR compound DD-3 | 0.005 |
| High-boiling solvent Oil-1 | 0.15 |
| Gelatin | 0.90 |
| Fifth layer: Intermediate layer | |
| Color stain preventive agent SC-1 | 0.10 |
| High-boiling solvent Oil-2 | 0.10 |
| Gelatin | 1.00 |

-continued

| Sample 201 | |
|---|---|
| Sixth layer: | |
| Low-speed green-sensitive emulsion layer Silver iodobromide emulsion (average grain size: 0.27 μm; average silver iodide content: 4 mol %) | 0.80 |
| Spectral sensitizer SD-2 | $8.5 \times 10^{-5}$ |
| Spectral sensitizer SD-3 | $8.0 \times 10^{-4}$ |
| Magenta coupler M-1 | 0.53 |
| Colored magenta coupler CM-2 | 0.09 |
| DIR compound DD-2 | 0.005 |
| DIR compound DD-3 | 0.01 |
| High-boiling solvent Oil-1 | 0.70 |
| Gelatin | 1.30 |
| Seventh layer: | |
| High-speed green-sensitive emulsion layer Silver iodobromide emulsion (average grain size: 0.38 μm; average silver iodide content: 6 mol %) | 0.90 |
| Spectral sensitizer SD-4 | $3.5 \times 10^{-4}$ |
| Spectral sensitizer SD-5 | $2.0 \times 10^{-5}$ |
| Magenta coupler M-1 | 0.17 |
| Colored magenta coupler CM-1 | 0.06 |
| DIR compound DD-2 | 0.05 |
| DIR compound DD-3 | 0.004 |
| High-boiling solvent Oil-2 | 0.40 |
| Gelatin | 0.80 |
| Eighth layer: Yellow filter layer | |
| Yellow colloidal silver | 0.10 |
| Color stain preventive agent SC-1 | 0.10 |
| High-boiling solvent Oil-2 | 0.10 |
| Gelatin | 1.00 |
| Ninth layer: | |
| Low-speed blue-sensitive emulsion layer Silver iodobromide emulsion (average grain size: 0.27 μm; average silver iodide content: 4 mol %) | 0.50 |
| Spectral sensitizer SD-6 | $7.0 \times 10^{-4}$ |
| Yellow coupler Y-1 | 0.40 |
| Yellow coupler Y-2 | 0.30 |
| DIR compound DD-1 | 0.01 |
| High-boiling solvent Oil-2 | 0.10 |
| Gelatin | 0.90 |
| Tenth layer: High-speed blue-sensitive emulsion layer | |
| Emulsion EM-1 | 0.65 |
| Spectral sensitizer SD-6 | $6.0 \times 10^{-4}$ |
| Yellow coupler Y-1 | 0.20 |
| High-boiling solvent Oil-2 | 0.08 |
| Gelatin | 0.55 |
| Eleventh layer: | |
| First protective layer Fine-grain silver iodobromide emulsion (average grain size: 0.08 μm) | 0.40 |
| Ultraviolet absorbent UV-1 | 0.07 |
| Ultraviolet absorbent UV-2 | 0.10 |
| High-boiling solvent Oil-1 | 0.07 |
| High-boiling solvent Oil-3 | 0.07 |
| Gelatin | 0.60 |
| Twelfth layer: Second protective layer | |
| Alkali-soluble matting agent (average particle diameter: 2.0 μm) | 0.15 |
| Polymethyl methacrylate (average particle diameter: 3.0 μm) | 0.04 |
| Lubricant WAX-1 | 0.04 |
| Gelatin | 0.60 |

C-1

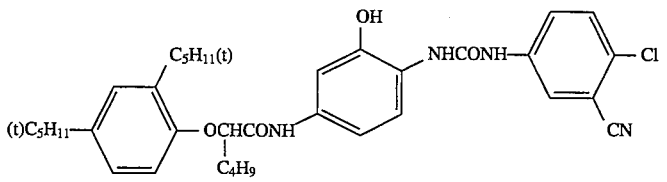

-continued
Sample 201
M-1
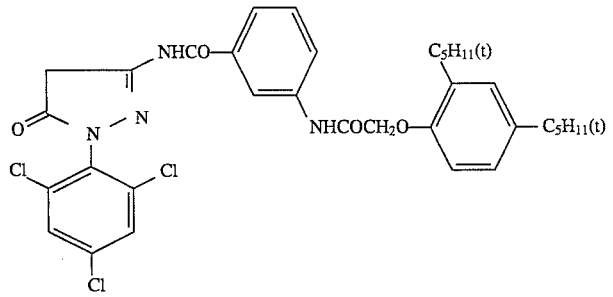
Y-1
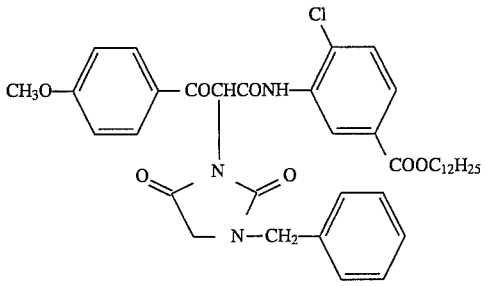
Y-2
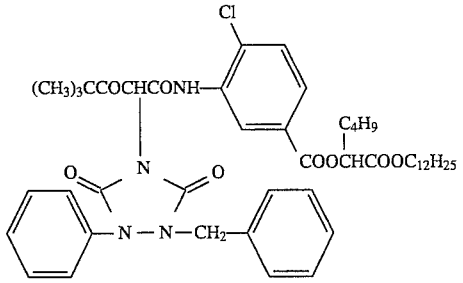
CC-1
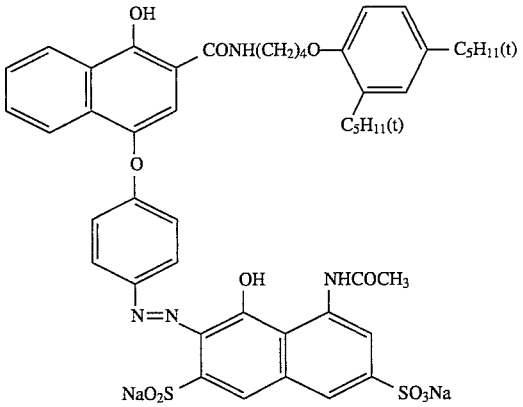
CM-1
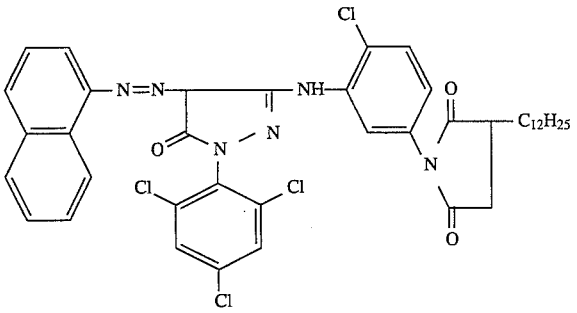

-continued
Sample 201
CM-2
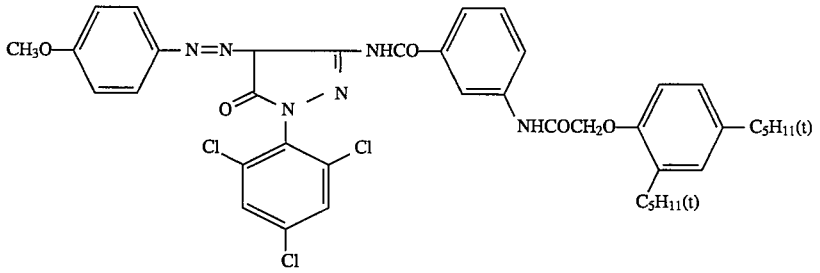
DD-1
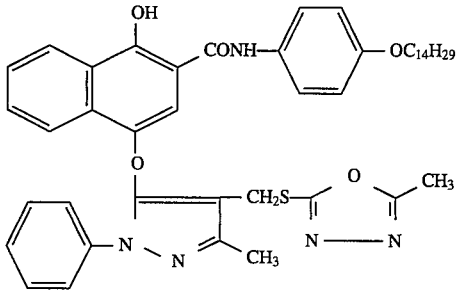
DD-2
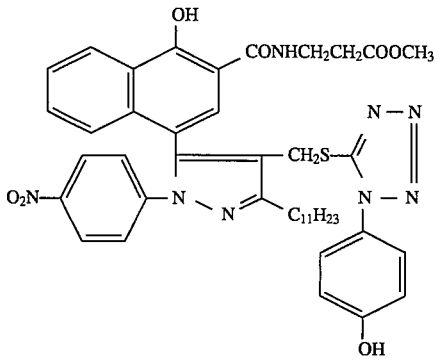
DD-3
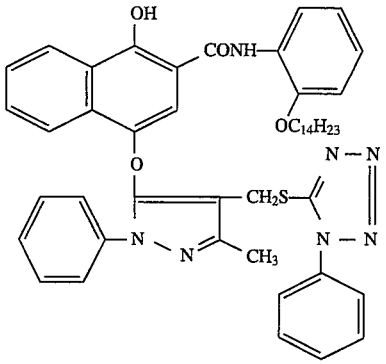
Oil-1
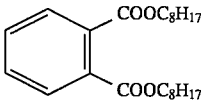
Oil-2
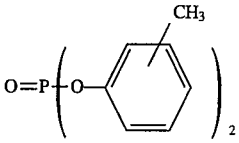

-continued
Sample 201
Oil-3
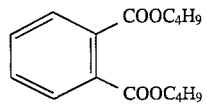
SC-1
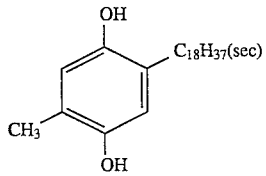
UV-1
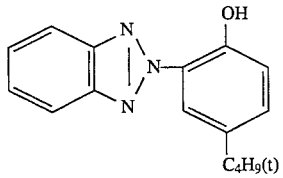
UV-2
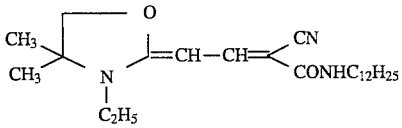
WAX-1
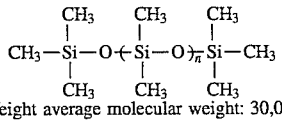
Weight average molecular weight: 30,000
SD-1
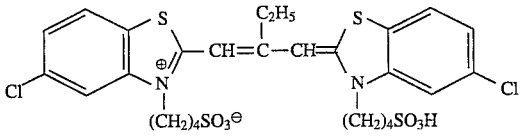
SD-2
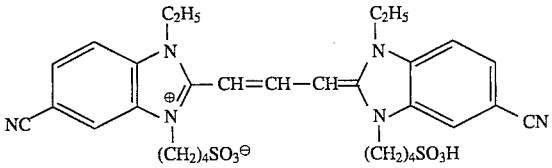
SD-3
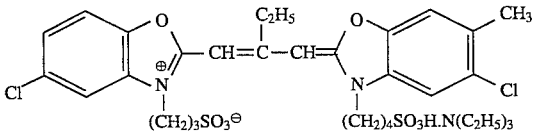
SD-4
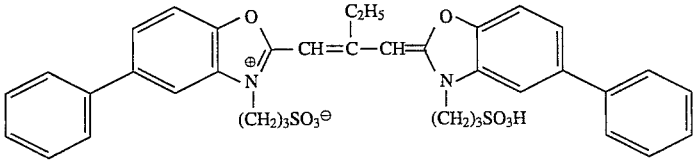
SD-5
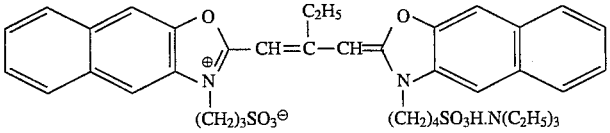

-continued

| Sample 201 | |
|---|---|
| 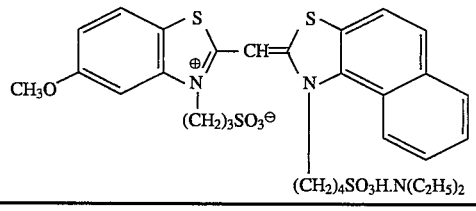 | SD-6 |

In addition to the foregoing compositions, coating aid Su-1, dispersion aid Su-2, a viscosity modifier, hardening agents H-1 and H-2, stabilizer ST-1, and antifoggants AF-1, and AF-2 in two kinds with Mw 10,000 and Mw 1,100,000 were added.

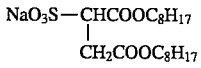

Su-1

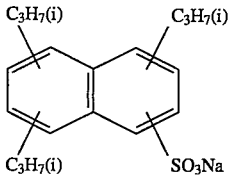

Su-2

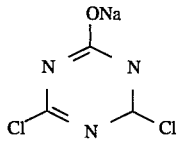

H-1

$(CH_2{=}CHSO_2CH_2)_2O$

H-2

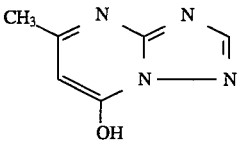

ST-1

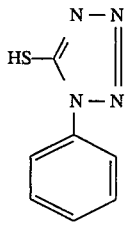

AF-1

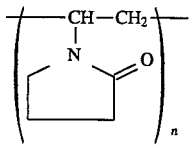

AF-2 n: Degree of polymerization

Samples Nos. 202 to 213 were further produced in the same manner as sample No. 201 except that the silver halide emulsion EM-1 used in the high-speed blue-sensitive emulsion layer was replaced with emulsions EM-2 to EM-13, respectively. The samples Nos. 201 to 213 were made ready for use by 5 pieces each. On all the samples, pressure characteristics (2 pieces were used), sharpness, sensitivity and graininess were evaluated.

Evaluation-1 of pressure characteristics

Unexposed samples were scratched with a diamond needle under a constant load of 5 g at a speed of 10 mm/sec. Subsequently the samples were photographically processed in the following way. After dried, blue-light transmission densities at the scratched portion and unscratched portion of the processed sample were measured, and a difference in densities at that portions was regarded as pressure mark. That is, the lower the density difference is, the better the pressure characteristics can be said to be. Table 2 shows the results of measurement on samples Nos. 201 to 213 (ΔD, fog portion).

Evaluation-2 of pressure characteristics

Before unexposed samples were subjected to wedge exposure using while light, the samples were folded at a curvature radius of 3 mm and a folding angle of 20° with their light-sensitive layers inside, and the folded samples were left for 5 seconds as they were. Thereafter the samples were exposed, and photographically processed in the following way. At portions with a density higher by +0.3 than the fog portion of the blue-sensitive layers, a change in densities at the folded portion and non-pressure portion was visually observed to make relative evaluation (bend test).

AA: No density change at all.

A: Density change slightly occurred.

B: Density change occurred.

C: Remarkable density change occurred.

Evaluation of sharpness

The samples were exposed to white light using a sharpness evaluation filter, and photographically processed in the following way. Thereafter, MTF (modulation transfer function) of color images was determined.

Table 2 show relative values of MTF at 20 lines/mm and 60 lines/mm.

Evaluation of relative sensitivity

In blue light measurement, the sensitivity was measured as a relative value of a reciprocal of the amount of exposure that gives a density of Dmin +0.15. Table 2 shows relative values assuming the sensitivity of sample No. 201 as 100.

Evaluation of graininess

RMS evaluation was employed. Densities at the measuring portions of the samples were scanned with a microdensitometer having an aperture scanning area of 1,800 μm (slit width: 10 μm; slit length: 180 μm), and RMS values were determined as values 1,000 times the standard deviation of the variations in density values of at least 1,000 sampling number of the density measurement. Table 2 shows relative values assuming the value of sample No. 201 as 100.

As will be seen from Table 2, the light-sensitive material of the present invention has a high sensitivity and a good graininess and also has a superior sharpness and pressure characteristics.

| Processing steps (38° C.): | |
|---|---|
| Color developing | 3 min 10 sec |
| Bleaching | 6 min 30 sec |
| Washing | 3 min 15 sec |
| Fixing | 6 min 30 sec |
| Washing | 3 min 15 sec |
| Stabilizing | 1 min 30 sec |
| Drying | |

Processing solutions used in the respective processing steps had the following composition.

| Color developing solution | |
|---|---|
| 4-Amino-3-methyl-N-ethyl-N-(β-hydroxyethyl)aniline sulfate | 4.75 g |
| Anhydrous sodium sulfite | 4.25 g |
| Hydroxyamine ½sulfate | 2.0 g |
| Anhydrous potassium carbonate | 37.5 |
| Sodium bromide | 1.3 g |
| Trisodium nitrilotriacetate (monohydrate) | 2.5 g |
| Potassium hydroxide | 1.0 g |
| Made up to 1 liter (pH: 10.0). | |
| **Bleaching solution** | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Made up to 1 liter by adding water, and adjusted to pH 6.0 using ammonium water. | |
| **Fixing solution** | |
| Ammonium thiosulfate | 175.0 g |
| Anhydrous sodium sulfite | 8.5 g |
| Sodium metasulfite | 2.3 g |
| Made up to 1 liter by adding water, and adjusted to pH 6.0 using acetic acid. | |
| **Stabilizing solution** | |
| Formalin (aqueous 37% solution) | 1.5 ml |
| KONIDAX (trade name; available from KONICA CORPORATION) | 7.5 ml |

Made up to 1 liter by adding water.

TABLE 2

| Sample No. | Emulsion | Relative sensitivity B | RMS B | Sharpness 20 lines/mm | Sharpness 60 lines/mm | Pressure characteristics ΔD (fog portion) | Pressure characteristics Bend test |
|---|---|---|---|---|---|---|---|
| 201 | EM-1 | 100 | 100 | 100 | 100 | +0.14 | A |
| 202 | EM-2 | 120 | 95 | 98 | 97 | +0.09 | B |
| 203 | EM-3 | 140 | 93 | 98 | 98 | +0.07 | B |
| 204 | EM-4 | 120 | 92 | 100 | 99 | +0.13 | B |
| 205 | EM-5 | 150 | 97 | 110 | 110 | +0.16 | A |
| 206 | EM-6 | 110 | 95 | 108 | 108 | +0.13 | A |
| 207 | EM-7 | 155 | 96 | 115 | 115 | +0.07 | AA |
| 208 | EM-8 | 130 | 90 | 90 | 93 | +0.05 | A |

TABLE 2-continued

| Sample No. | Emulsion | Relative sensitivity B | RMS B | Sharpness 20 lines/mm | Sharpness 60 lines/mm | Pressure characteristics ΔD (fog portion) | Pressure characteristics Bend test |
|---|---|---|---|---|---|---|---|
| 209 | EM-9 | 150 | 83 | 108 | 107 | +0.05 | A |
| 210 | EM-10 | 170 | 87 | 118 | 118 | +0.07 | AA |
| 211 | EM-11 | 160 | 78 | 109 | 108 | +0.03 | A |
| 212 | EM-12 | 180 | 75 | 107 | 107 | +0.02 | A |
| 213 | EM-13 | 180 | 70 | 110 | 109 | +0.02 | AA |

As having been described above, the present invention improves both the pressure characteristics and the sharpness without causing the deterioration of graininess, when the silver halide emulsion satisfies the conditions (a) and (b) as described above.

What is claimed is:

1. A silver halide emulsion comprising a dispersion medium and light-sensitive silver halide grains, wherein said silver halide grains in said emulsion consist essentially of grains having two or more twin planes and satisfying the following requirements:

(1) the average longest distance between twin planes is 10 to 100 Å, (2) said silver halide grains have an average iodide content of at least 3 mol %, and each comprises a core and a shell, wherein said core contains silver iodobromide having a silver iodide content of not less than 7 mol %; and said shell comprises one layer or two or more layers different in halide composition from each other, wherein at least one layer of said shell comprises silver iodobromide or silver bromide, the outermost layer of said shell having a silver iodide content of 0 to 4 mol %.

2. The silver halide emulsion of claim 1, wherein said silver halide grains comprise hexagonal tabular grains in an amount of not less than 50% of the whole projection area of said silver halide grains.

3. The silver halide emulsion of claim 2, wherein said tabular grains have an average thickness of 0.3 μm or less.

4. The silver halide emulsion of claim 2, wherein said tabular grains have an average aspect ratio of 7 or less.

5. The silver halide emulsion of claim 1, wherein the relative standard deviation of the average iodide content is 20% or less.

6. The silver halide emulsion of claim 1, wherein a part or all of said silver halide grains is formed by feeding silver halide fine grains into a reactor.

7. The silver halide emulsion of claim 6, wherein said fine grains are fed in the presence of silver halide seed grains.

8. A light-sensitive silver halide color photographic material comprising a support having thereon a red-sensitive silver halide emulsion layer, a green-sensitive silver halide emulsion layer and a blue-sensitive silver halide emulsion layer, wherein at least one of said silver halide emulsion layers comprises said silver halide emulsion as claimed in claim 1.

* * * * *